US006347899B1

(12) United States Patent
Vierboom

(10) Patent No.: US 6,347,899 B1
(45) Date of Patent: Feb. 19, 2002

(54) DEVICE FOR APPLYING LIQUID MEDIA TO THE SKIN

(75) Inventor: Werner Vierboom, Ahrensburg (DE)

(73) Assignee: Beiersdorf AG, Hamburg (DE)

( * ) Notice: Subject to any disclaimer, the term of this patent is extended or adjusted under 35 U.S.C. 154(b) by 0 days.

(21) Appl. No.: 09/436,168

(22) Filed: Nov. 9, 1999

(30) Foreign Application Priority Data

Nov. 18, 1998 (DE) ..... 198 53 253

(51) Int. Cl.[7] ..... A46B 11/00
(52) U.S. Cl. ..... 401/190; 401/205; 401/206
(58) Field of Search ..... 401/190, 130, 401/119, 120, 123, 206, 205

(56) References Cited

U.S. PATENT DOCUMENTS 3,256,549 A * 6/1966 Evesque ..... 401/190
3,841,532 A * 10/1974 Gores ..... 401/190
5,567,073 A * 10/1996 De Laforcade et al. ..... 401/190
5,692,846 A * 12/1997 Schwarzberg ..... 401/190
5,899,623 A * 5/1999 De Laforcade ..... 401/190
6,004,056 A * 12/1999 De Laforcade ..... 401/190

* cited by examiner

*Primary Examiner*—David J. Walczak
(74) *Attorney, Agent, or Firm*—Norris McLaughlin & Marcus

(57) ABSTRACT

Device for applying liquid media to the skin, composed of a vessel containing the fluid, the vessel being formed from a pressurized gas package with a spray valve and an application element which is attached to this vessel and to which the fluid from the vessel can be fed, wherein the application element 4 is composed of a mount 41 which is fitted onto the vessel 1 and of a moveably mounted carrier element 42, the carrier element 42 bearing on the spray valve 3, and holding a distributor head 43 which has the filling applied to it when the spray valve 3 is triggered, and being capable of being guided in the mount 41 essentially in parallel with the axis 31 of the spray valve, the spray valve 3 being activated by lightly pressing on or tilting the distributor head 43.

13 Claims, 3 Drawing Sheets

DEVICE FOR APPLYING LIQUID MEDIA TO THE SKIN

DESCRIPTION

The invention relates to a device for applying liquid media to the skin, composed of a vessel which contains a fluid and of an application element which is attached to this vessel and to which the fluid from the vessel can be fed.

Devices for applying liquid media to the skin are known in the prior art.

Thus, EP 0 155 350 A2 discloses an application device for applying liquid media to the skin, which is composed of a vessel which contains the fluid and of a porous head which is held in position on the vessel by means of a flexible connecting element. By pressing on the head, the latter is pressed vertically downwards into the vessel, the resulting rise in pressure in the vessel being used to press the fluid out of the vessel and into the head. The fluid passes through the pores of the head to the surface of the head and is distributed on the skin.

EP 0 374 339 A1 shows a pressurized can which represents a storage vessel for deodorants or comparable fluids. The sponge, on which the fluid which forces it way out of the can acts when the valve is activated, is arranged on the valve of the can. The sponge is attached to a cylindrically shaped carrier which can simultaneously permit the valve to be triggered. Furthermore, the carrier is pressed onto the neck of the can.

DE 40 16 139 makes available a fluid applicator for cosmetic fluids, which has a discharge head which itself has a hood of a porous material. Furthermore, a closure on the neck of a flacon is part of the discharge head, the flacon containing at least one opening which connects the flacon to the hood and to a casing. The casing has support elements for the hood and is mechanically connected to the closure and can be moved manually. The hood is fabricated from a porous, inelastic material. In this applicator, the opening of a valve, through which the fluid located in the applicator can pass into the porous hood, is also affected by means of pressure on the discharge head.

Finally, EP 0 655 208 A1 presents a device for applying a fluid to the skin, which is composed of a vessel for the fluid which is to be applied to the surface to be treated, and of a distributor cap. The distributor cap is connected to the aforesaid vessel by means of a spray head. The distributor cap is made of a porous material which is suitable for applying the fluid by simply rubbing the outer surface of the cap on the surface to be treated. The vessel is a pressurized tank which is equipped with a spray valve. The distributor cap is held by a support which is a component of the spray head and is mechanically connected to an attachment which can cooperate with the aforesaid valve in order to cause it to open as a result of the effect of mechanical activation which is exerted on the distributor cap. When it opens, the fluid which is ejected from the tank is guided through the attachment to the surface of the distributor cap which is opposite the outside of the cap. The spray head which constitutes a plastic part shaped in an element has a securing device which can be used to connect the aforesaid head to the tank to form one element. The securing device is composed of an inelastic jacket which is secured on the tank by engaging an engagement area.

It is essential to the invention that an elastic part connects the aforesaid holding device and the support of the distributor cap to one another, the inelastic jacket being connected, in addition to its other enclosure, to a cylindrical wall which actually forms this elastic part.

EP 0 037 903 A1 discloses a fitting for an aerosol can in which a cylindrical mounting element is plugged onto this aerosol can and tilted. The mounting element has a central bore into which a carrier is introduced, the movement of the latter being limited by a stop. The carrier serves to hold a sponge or a brush.

Then, U.S. Pat. No. 5,230,579 discloses a further fitting for an aerosol can. The spray head of the fitting has a distributor head which is formed from a fixed porous material and which, moreover, is also of a curved shape. Polyethylene is specifically mentioned as the material for the distributor head.

The invention is based on the object of making available a device for applying liquid media, in particular to the skin, which device ensures that the media are applied in a simple and pleasant way and which is of a simple design.

This object is achieved by means of a device such as is characterized in more detail in the claims. Advantageous developments of the device are the subject matter of the subclaims here.

Accordingly, the invention proposes a device for applying liquid media to the skin, for example deodorants under the armpit, which is composed of a vessel containing a fluid, the vessel being formed from a pressurized gas package with a spray valve and an application element which is attached to this vessel and to which element the fluid can be fed from the vessel. The application element itself is composed of a mount which is fitted onto the vessel, and of a moveably mounted carrier element, the mount being shaped in such a way that the carrier element can be held.

The carrier element has the following features:

It bears on the spray valve.

It holds a distributor head which has the filling applied to it when the spray valve is triggered.

It can be guided in the mount essentially parallel to the axis of the spray valve mount, the spray valve being activated by lightly pressing on or tilting the distributor head.

In one preferred embodiment, the spray valve is a tilt valve. Furthermore, it is proven advantageous if the spray valve has a pin which emerges from it and which is, to a certain extent, pressed tightly into a duct in the interior of the carrier element.

The application element can be attached to the vessel by means of the spray valve, and the mount can be attached to the valve poppet.

In a further preferred embodiment of the device according to the invention, the vessel is composed of a cylindrical metal bottle whose upper part is shaped as an arc. The arc is fitted with a spray valve, an engagement groove being provided in the connecting area between the cylindrical wall and the arcuate wall. The mount is of a cylindrical shape and has in the region of one of its edges an engagement device which can interact with the engagement groove.

In order to ensure the releasable connection between the mount and carrier element, the carrier element can have a cylindrical wall which has a downwardly directed, annular widened portion. The cylindrical wall of the carrier element is guided here in a portion of the mount in such a way that the annular widened portion undercuts the mount. The undercut should move within a range of a few millimetres so that the carrier element and mount can be separated by pulling on the carrier element. Furthermore, in this way it is possible for the carrier element to be easily pressed into the mount when the device is being mass produced.

The carrier element can be equipped with an eddy chamber in order to homogenize the fluid emerging from the vessel before said fluid enters the distributor head. In this way a larger area of the distributor head is wetted. A further improvement in the distribution of the fluid in the eddy chamber can be achieved by spraying the fluid from the spray valve and into the eddy chamber through a bottom plate with 2 to 5 nozzles. The diameter of the preferably circular nozzles is 0.5 to 2 mm in an advantageous embodiment.

In a further preferred embodiment of the device according to the invention, the distributor head is composed of porous material. The distributor head should have a thickness of between 1 mm and 4 mm above the eddy chamber. Furthermore, it has turned out to be advantageous if the distributor head is composed of a sintered material which is fabricated by compressing plastic particles or an open-celled foam; this material is possibly covered by a fabric. The shape of the distributor head is preferably matched to the armpit.

The porosity of the material of which the distributor head is composed can be between 10 $\mu$m and 500 $\mu$m, in particular between 10 $\mu$m and 200 $\mu$m.

The application face of the distributor head which bounds the distributor head towards the outside and which comes into contact with the skin when the device is used has a roughness, and specifically the average value Ra of the divergence in roughness should be between 0.5 $\mu$m and 100 $\mu$m, preferably between 10 $\mu$m and 30 $\mu$m.

In one preferred embodiment of the device, the fluid which is to be distributed is a fluid with a cosmetic or dermopharmaceutical effect which is applied locally to the skin of a user.

The device according to the invention is characterized by a number of advantages. The structural design with three individual parts can be fabricated particularly simply and economically. By means of the eddy chamber, the quantity of fluid which is to be metered can be distributed particularly advantageously and in an optimum way before it arrives at the distributor head, so that by virtue of this precise metering an overall reduction is obtained in comparison with the known application systems. This effect is enhanced further by the nozzles located in the bottom plate. The sintered part, which can have a considerably reduced wall thickness, permits significantly more spontaneous reactions of the device because the filling is available at the surface of the distributor head considerably more quickly. The quantity of fluid which remains in the distributor head after use, and subsequently vaporizes without being used is also considerably smaller.

A preferred embodiment of the device according to the invention will be presented below with reference to a figure, without any intention of having a limited effect whatsoever.

Figure 1:
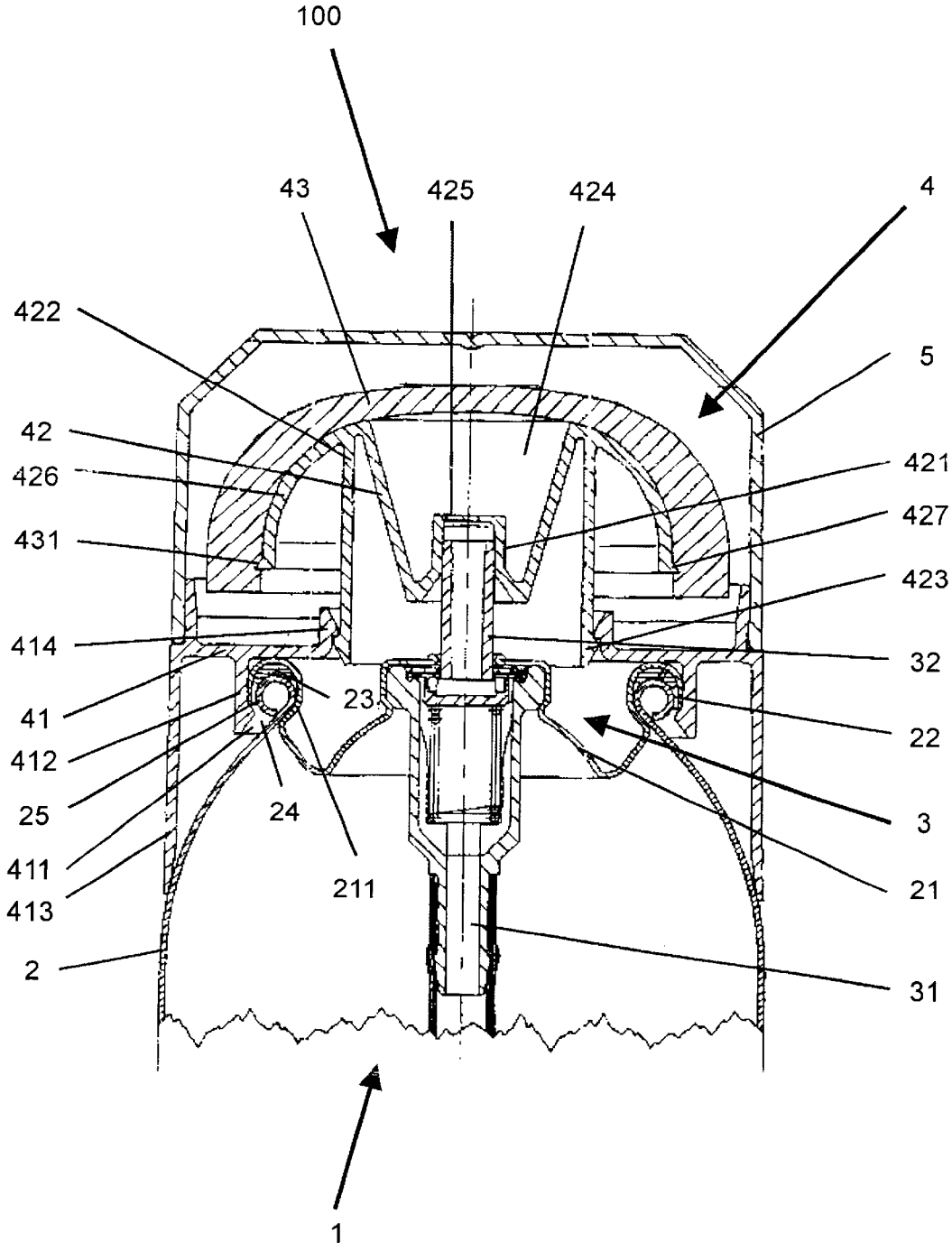
FIG. 1 shows a particularly advantageous version of the device according to the invention.
Figure 2:
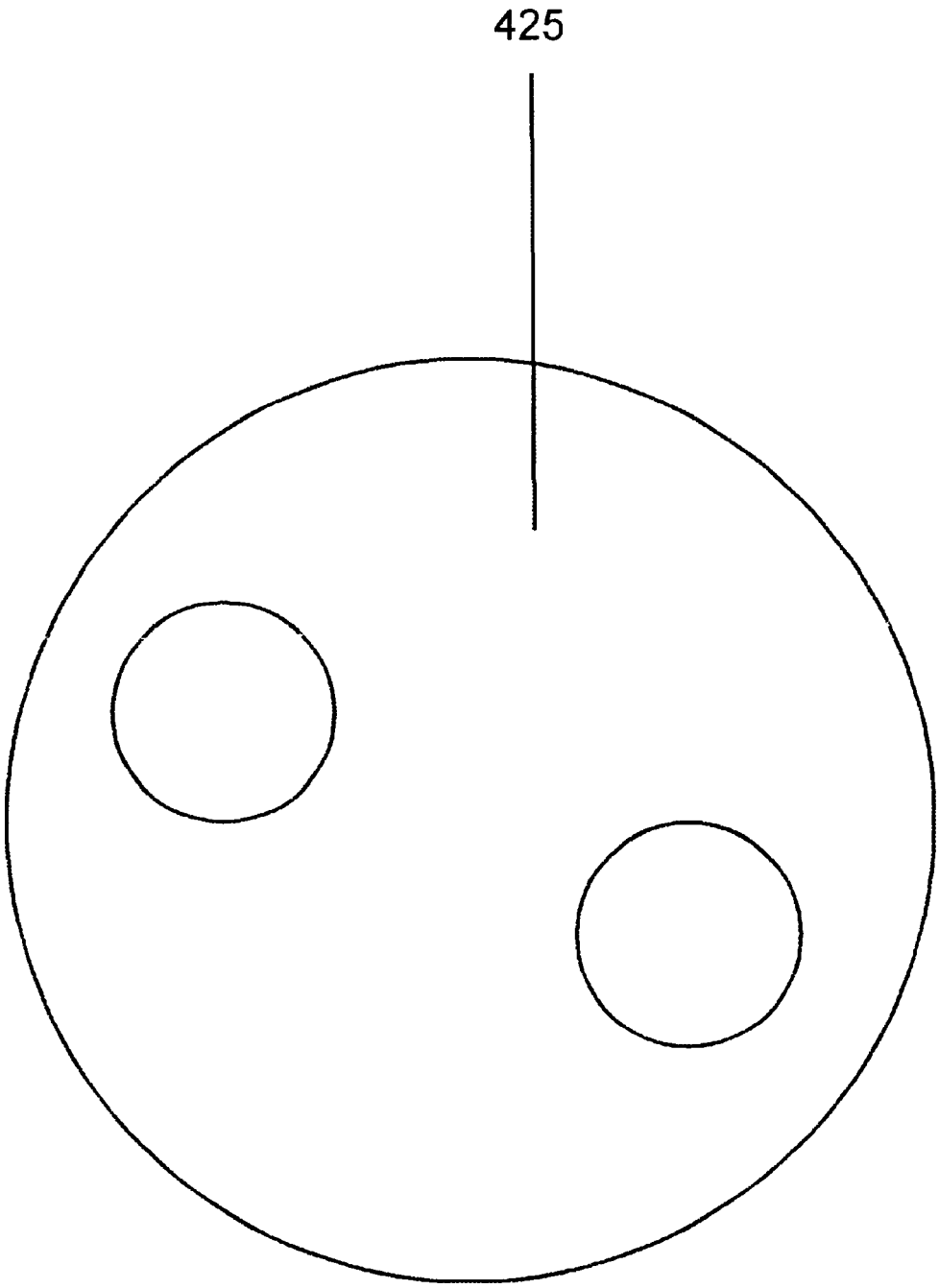
FIG. 2 shows a bottom plate with two (2) nozzles.
Figure 3:
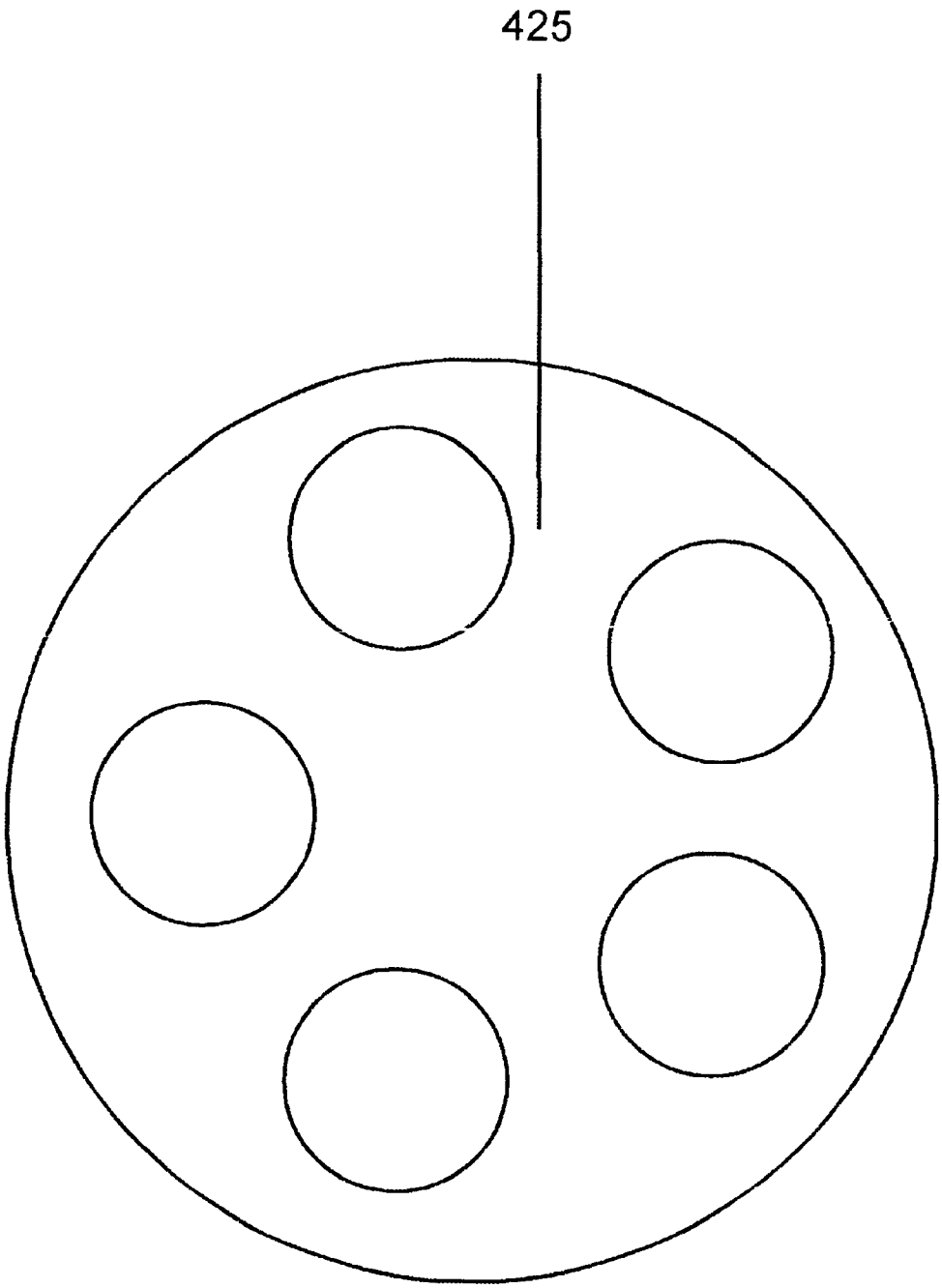
FIG. 3 shows a bottom plate with five (5) nozzles.

According to the above, the device 100 for applying liquid media to the skin is composed of a vessel 1 containing a fluid, the vessel 1 being formed from a pressurized gas package 2 with a spray valve 3—preferably a tilt valve, and of an application element 4 which is attached to this vessel 1 and to which the fluid from the vessel 1 can be fed.

The application element 4 is composed of a mount 41 which is fitted on the vessel 1, and of a moveably mounted carrier element 42 which bears on the spray valve 3 and which holds a distributor head 43 which has the filling applied to it when the spray valve 3 is triggered and which can be guided essentially in parallel with the axis 31 of the spray valve in the mount 41, the spray valve 3 being activated by slightly pressing on or tilting the distributor head 43.

The pressurized gas vessel 2 is formed from a conventional aerosol can made of aluminium, which has a circular valve poppet 21 which is permanently connected to the rim 25 of the aerosol can in the edge region 211 by means of a chamfer 22 together with a sealing material 23. The spray valve 3 is located in the valve poppet 21.

The spray valve 3 has a cylindrical pin 32 which emerges from it and part of which is guided tightly in a cylindrical duct 421 in the interior of the carrier element 42. The duct 421 is preferably arranged centrally in order to ensure, that the device 100 has a uniform shape.

An engagement groove 24 is provided in the connecting region between rim 25 and the wall of the pressurized vessel at the upper region of the pressurized gas vessel 2. An engagement device 411 of the mount 41 can interact with this engagement groove 24. For this purpose, the mount 41 has a cylindrical shaped wall 412 in the region of the engagement device 411. In addition, the mount 41 is supported on the pressurized gas vessel 2 by means of a further wall 413.

In order to ensure the releasable connection between the mount 41 and carrier element 42, the carrier element 42 preferably has a cylindrical wall 422 which has an outwardly directed, annular widened portion 423. The cylindrical wall 422 of the carrier element 42 is guided here in a portion 414 of the mount 41 in such a way that the annular widened portion 423 undercuts the mount 41. The undercut should be within the range of a few millimetres so that the carrier element 42 and mount 41 can be separated by pulling on the carrier element 42. Furthermore, this ensures that the carrier element 42 can be pressed easily into the mount 41 when the device 1 is being mass produced.

The carrier element 42 is equipped with an eddy chamber 424 which ensures that the fluid emerging from the vessel 1 is homogenized before it enters the distributor head 43. A further improvement in the distribution of the fluid in the eddy chamber 424 is achieved by virtue of the fact that the fluid from the spray valve 3 is sprayed into the eddy chamber 424 through a bottom plate 425 with 2to 5nozzles. The bottom plate 425 forms a termination for the duct 421. The nozzles provided in the bottom plate 425 are preferably circular and distributed symmetrically over the entire bottom plate 425. The eddy chamber 424 is preferably of rotational symmetrical design, and specifically corresponds to an upwardly open cylinder which constantly tapers slightly towards the bottom plate.

The distributor head 43 is composed of porous material, specifically sintered material which has been fabricated by compressing plastic particles. The distributor head 43 is in the shape of a hemisphere. Above the eddy chamber 424 the distributor head 43 is two millimetres thick. In the edge region of the distributor head 43, said head lies on the mount 42, specifically on a mushroom-shaped widened portion 426 which is hollowed above the eddy chamber 424. The terminating edge of the mushroom-shaped widened portion 426 has a circumferential projection 427 which engages in a corresponding groove 431 in the distributor head 43 so that the distributor head 43 bears securely on the mount 42.

In order to enable the preferred application of a deodorizing compound into the armpit by means of the device 100, the shape of the distributor head 43 is adapted to the armpit. Finally, the distributor head 43 is covered with a cap 5 made of plastic which is also fitted onto the mount 41 with a gentle press fit.

What is claimed is:

1. A device for applying a liquid media to the skin, composed of a vessel containing the liquid media, the vessel being formed from a pressurized gas package with a spray valve having an axis and an application element adapted to be attached to said vessel and to which the liquid media from the vessel can be fed, wherein the application element is composed of a mount which is adapted to be fitted onto the vessel and of a moveably mounted carrier element, said carrier element having an eddy chamber wherein said eddy chamber is an upwardly open cylinder which constantly tapers slightly towards the bottom and bearing on the spray valve, holding a distributor head which has the liquid media applied to it when the spray valve is triggered, and being capable of being guided in the mount essentially in parallel with the axis of the spray valve, the spray valve being activated by pressing on or tilting the distributor head.

2. Device according to claim 1, wherein the spray valve is a tilt valve.

3. Device according to claim 1, wherein the spray valve has a pin emerging therefrom and which is pressed into a duct in carrier element.

4. Device according to claim 1, wherein the application element is attached to the vessel by means of the spray valve.

5. Device according to claim 1, wherein said pressurize gas package has a circular valve poppet and the mount is attached to the valve poppet.

6. Device according to claim 1, wherein the vessel is composed of a cylindrical metal bottle whose upper part is formed as an arc and has a rim which is fitted with the spray valve, an engagement groove being provided between an arcuate wall located in the upper region of the cylindrical metal bottle and the rim, and the mount has a cylindrical shaped wall which engages with the engagement groove.

7. Device according to claim 1, wherein the carrier element has a cylindrical wall which has a downwardly directed, annular widened portion, and the cylindrical wall of the carrier element is guided in a portion of the mount in such a way that the annular widened portion undercuts the mount.

8. Device according to claim 1, wherein the liquid media from the spray valve is sprayed into the eddy chamber through a bottom plate having 2 to 5 nozzles.

9. Device according to claim 1, wherein the distributor head is composed of porous material.

10. Device according to claim 9, wherein the porosity of the material of which the distributor head is composed is between 10 $\mu$m and 500 $\mu$m.

11. Device according to claim 1, wherein the distributor head has a thickness of between 1 mm and 4 mm above the eddy chamber.

12. Device according to claim 1, wherein the distributor head is composed of a sintered material which is fabricated by compressing plastic particles or an open-celled foam and is optionally coated by a fabric.

13. Device according to claim 1, wherein the liquid media which is to be distributed is a liquid media with a cosmetic or dermopharmaceutical effect which is applied locally to the skin of a user.

* * * * *